US009016391B1

(12) United States Patent
Chauffe

(10) Patent No.: US 9,016,391 B1
(45) Date of Patent: Apr. 28, 2015

(54) SWELLABLE PACKER WITH INTERNAL BACKUP RING

(75) Inventor: Stephen J. Chauffe, The Woodlands, TX (US)

(73) Assignee: Team Oil Tools, L.P., The Woodlands, TX (US)

( * ) Notice: Subject to any disclaimer, the term of this patent is extended or adjusted under 35 U.S.C. 154(b) by 230 days.

(21) Appl. No.: 13/597,382

(22) Filed: Aug. 29, 2012

(51) Int. Cl.
*E21B 33/12* (2006.01)

(52) U.S. Cl.
CPC ..... *E21B 33/12* (2013.01)

(58) Field of Classification Search
CPC ..... E21B 33/12; E21B 33/1216
USPC ..... 166/387, 180, 192, 195, 196
See application file for complete search history.

(56) References Cited

U.S. PATENT DOCUMENTS

| | | | | |
|---|---|---|---|---|
| 5,280,824 | A | 1/1994 | Eslinger et al. | |
| 5,613,555 | A | 3/1997 | Sorem et al. | |
| 6,056,052 | A | 5/2000 | Mullen et al. | |
| 6,712,153 | B2 | 3/2004 | Turley et al. | |
| 6,957,815 | B1 | 10/2005 | Inciong | |
| 7,165,622 | B2 | 1/2007 | Hirth et al. | |
| 7,431,098 | B2 | 10/2008 | Ohmer et al. | |
| 7,575,060 | B2 | 8/2009 | Hillis et al. | |
| 7,708,080 | B2 | 5/2010 | Conaway et al. | |
| 7,748,468 | B2 * | 7/2010 | Casciaro | 166/387 |
| 7,806,193 | B2 | 10/2010 | Berzin et al. | |
| 7,849,930 | B2 * | 12/2010 | Chalker et al. | 166/387 |
| 2005/0073111 | A1 | 4/2005 | Herpin et al. | |
| 2009/0130938 | A1 * | 5/2009 | Xu et al. | 442/327 |
| 2010/0126733 | A1 | 5/2010 | Rytlewski | |
| 2010/0294484 | A1 | 11/2010 | Castillo et al. | |
| 2011/0073312 | A1 | 3/2011 | Lembcke et al. | |
| 2011/0088892 | A1 * | 4/2011 | Freyer | 166/134 |
| 2011/0266752 | A1 | 11/2011 | Kocurek et al. | |
| 2012/0031608 | A1 | 2/2012 | Lembcke et al. | |

OTHER PUBLICATIONS

Weatherford Swellable Products, Fraxsis Annulus Swellable Packer, 2009-2012 (item 7179.03).

* cited by examiner

*Primary Examiner* — William P Neuder
(74) *Attorney, Agent, or Firm* — MH2 Technology Law Group, LLP

(57) ABSTRACT

A swellable packer includes a base pipe; a swellable sealing element disposed around the outer diameter of the base pipe; and at least one internal backup ring disposed within the swellable sealing element. It may be manufactured by disposing the internal backup ring on the base pipe; applying an elastomeric material over a section of the base pipe and the internal backup ring; and applying a bonding agent over the section of the base pipe and the at least one internal backup ring. It may be used to isolate a section of a well by disposing a swellable packer in the well, and exposing the swellable packer to a fluid, wherein the fluid exposure causes the elastomeric material to radially expand into contact with a well wall.

20 Claims, 8 Drawing Sheets

SWELLABLE PACKER WITH INTERNAL BACKUP RING

BACKGROUND

1. Field

Embodiments disclosed herein relate to apparatuses and methods for manufacturing swellable packers. More specifically, embodiments disclosed herein relate to apparatuses and methods for manufacturing swellable packers having internal backup rings. More specifically still, embodiments disclosed herein relate to apparatuses and methods for manufacturing swellable packers having internal backup rings that reduce fracture propagation through swellable elastomers.

2. Background

This section introduces information from the art that may be related to or provide context for some aspects of the technique described herein and/or claimed below. This information is background facilitating a better understanding of that which is disclosed herein. This is a discussion of "related" art. That such art is "related" in no way implies that it is also "prior" art. The related art may or may not be prior art. The discussion is to be read in this light, and not as admissions of prior art.

In the oilfield industry, various downhole tools known as packers are used to isolate sections of a well. While various types of packers may be used, two commonly employed types of packers include mechanical/hydraulic setting, radially expandable packers and swellable packers. Mechanical/hydraulic setting radially expandable packers have a radially expandable elastomeric seal that is forced radially outward by either a mechanical or hydraulic force. The expanded elastomeric seal is typically held in place by a series of cones and lock rings that engage, thereby preventing the elastomeric seal from contracting. Certain hydraulic expandable packers activate under a flow of fluid, and stay expanded as long as the flow of fluid is maintained.

Swellable packers rely on elastomers that expand and form an annular seal when contacted with certain wellbore fluids. Typically, the elastomers used in swellable packers are either oil or water sensitive and the expansion rates and pressure ratings are affected by a number of factors, such as temperature, pressure, fluid content, etc. Oil activated elastomers are activated by contact with a hydrocarbon-based fluid, and the expansion is affected by fluid temperatures, as well as the concentration and specific gravity of the hydrocarbons in the fluid. Water activated elastomers are activated by contact with a water-based fluid. The expansion of water activated elastomers is affected by the water temperature and salinity.

During use, the elastomeric material of the swellable packers may be employed in harsh downhole environments that may include high temperatures, high pressures, and acidic or otherwise caustic environments. The downhole environment often results in cracks forming in one or more locations on the elastomeric material. When a crack forms, over time, the crack may propagate throughout the elastomeric material. As the crack grows, the sealing integrity of the swellable packer may degrade to the point where the swellable packer is no longer forming a barrier in the well, and the zones on either side of the packer are not separated. When such a condition occurs, the packer is said to have failed and requires removal and replacement.

Accordingly, there exists a continuing need for swellable packers that resist crack propagation. The presently disclosed technique is directed to resolving, or at least reducing, one or all of the problems mentioned above. Furthermore, the art is always receptive to improvements or alternative means, methods and configurations.

SUMMARY

In one aspect, embodiments disclosed herein relate to: a swellable packer comprising: a base pipe; a swellable sealing element disposed around the outer diameter of the base pipe; and at least one internal backup ring disposed within the swellable sealing element.

In a second aspect, it relates to a method of manufacturing a swellable packer, the method comprising: disposing at least one internal backup ring on a base pipe; applying an elastomeric material over a section of the base pipe and the at least one internal backup ring; and applying a bonding agent over the section of the base pipe and the at least one internal backup ring.

In a third aspect, it relates to a method of isolating a section of a well, the method comprising: disposing a swellable packer in the well, the swellable packer comprising a base pipe, at least one internal backup ring, and an elastomeric material disposed over at least a section of the base pipe and the at least one internal backup ring; and exposing the swellable packer to a fluid, wherein the fluid exposure causes the elastomeric material to radially expand into contact with a well wall.

The above presents a simplified summary of the present disclosure in order to provide a basic understanding of some aspects of the invention. This summary is not an exhaustive overview of the invention. It is not intended to identify key or critical elements or to delineate the scope of the invention. Its sole purpose is to present some concepts in a simplified form as a prelude to the more detailed description that is discussed later.

BRIEF DESCRIPTION OF DRAWINGS

The claimed subject matter may be understood by reference to the following description taken in conjunction with the accompanying drawings, in which like reference numerals identify like elements, and in which:

While the subject matter claimed below is susceptible to various modifications and alternative forms, the drawings illustrate specific embodiments herein described in detail by way of example. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION

One or more specific embodiments of the present invention will be described below. The present invention is not limited to the embodiments and illustrations contained herein, but include modified forms of those embodiments including portions of the embodiments and combinations of elements of different embodiments as come within the scope of the appended claims. In the development of any such actual implementation, as in any engineering or design project, numerous implementation-specific decisions must be made to achieve the developers' specific goals, such as compliance with system-related and business related constraints, which may vary from one implementation to another. Moreover, such a development effort might be complex and time consuming, but would nevertheless be a routine undertaking of design, fabrication, and manufacture for those of ordinary skill having the benefit of this disclosure.

Figure 1:
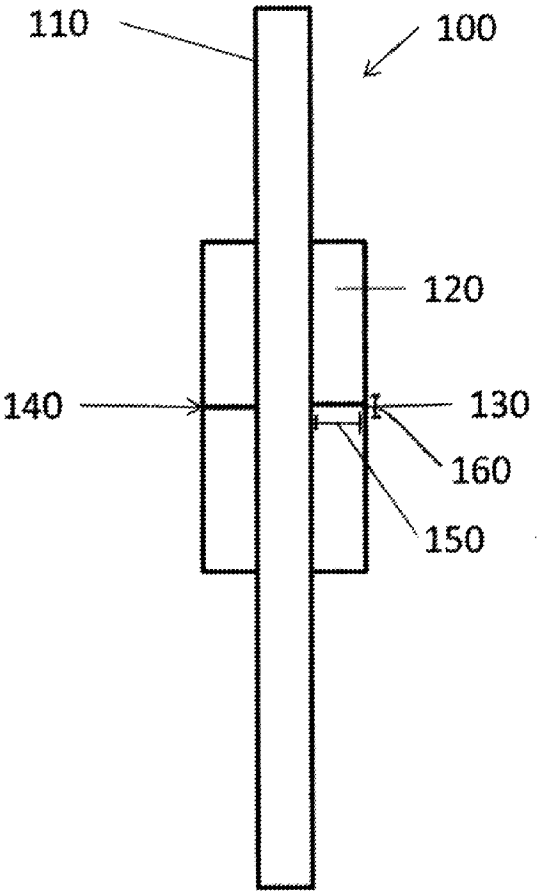
FIG. 1 is a cross-sectional view of a swellable packer according to embodiments of the present disclosure.

Referring to FIG. 1, a cross-sectional view of a swellable packer 100 according to embodiments of the present disclosure is shown. In this embodiment, swellable packer 100 includes a base pipe 110. The base pipe 110 may be any type of pipe used in the oilfield industry including, for example, pipes made from metals and metal alloys, such as stainless steel, as well as composites, such as fiber glass and epoxy. The base pipe 110 may further be of various diameters such as, for example, pipes having an outer diameter of 2⅜ inches, 2⅞ inches, 3½ inches, 5½ inches, 6⅝ inches, and others, both greater and smaller. Similarly, the wall thickness of base pipe 110 may also vary, for example, pipes having a wall thickness of 0.28 inches, 0.362 inches, 0.5 inches, 0.362 inches, etc. may be used. The inner diameter of base pipe 110 may also vary. For example, drill pip 110 may have an inner diameter of, for example, 1.815 inches, 2.151 inches, 3.34 inches, 4.0 inches, etc.

Those of ordinary skill in the art having the benefit of this disclosure will appreciate that the precise specifications of the base pipe 110 used in a particular swellable packer 100 may vary based on the conditions in which the swellable packer 100 may be used. For example, such packers may be used in both on-shore and off-shore applications in wells having varying lengths and angles. Each specific operation may require different base pipe 110 dimensions. The present disclosure is not a limitation on the specific dimensions of base pipe 110 used.

Swellable packer 100 further includes a swellable sealing element 120 disposed around the outer diameter of base pipe 110. Swellable sealing element 120 may include an elastomeric material wrapped or otherwise formed around base pipe 110. Various elastomeric materials may be used in forming swellable sealing element 120. Depending on the type of fluids (not shown) used in a particular well, the material used to form swellable sealing element 120 will vary.

For example, a swellable sealing element 120 configured to swell in hydrocarbon-based fluids (e.g., oil-based fluids) may be formed from ethylene propylene diene monomer rubber. A swellable sealing element 120 configured to swell in water-based fluids may be formed from, for example, N-vinyl carboxylic acid amide-based cross-linked resin and a urethane in an ethylene propylene rubber matrix. In certain embodiments, an elastomeric material that may swell in both water-based and hydrocarbon-based fluids may also be used.

In addition to base pipe 110 and swellable sealing element 120, swellable packer 100 further includes at least one internal backup ring 130 that is disposed within the swellable sealing element 120. Internal backup ring 130 may be formed from various metals and metal alloys, such as stainless steel, as well as various composite materials. The internal backup ring 130 is configured to prevent crack propagation within the swellable sealing element 120.

As described above, over time, cracks may begin to form in the swellable sealing element 120 as a result of the fluids and pressures that swellable packer 100 is exposed to within a well. The cracks, if not stopped from spreading, may eventually result in failure of the swellable packer 100. Internal backup ring 130 is configured to prevent cracks from spreading, even if small cracks form over time. Because internal backup ring 130 prevents cracks from spreading, even if a crack forms, the crack with terminate into an internal backup ring 130, thereby preventing the crack from becoming large enough to result in failure of the swellable packer 100. More particularly, the intern backup ring 130 will prevent a crack from propagating from one end of the swellable sealing element 120 to the other, thereby preventing creation of a leak path.

Internal backup ring 130 may be formed of various geometries and may be disposed within swellable sealing element 120 in various orientations. In one embodiment, internal backup ring 130 may be a circular disc that extends around the base pipe 360°. In alternate embodiments, internal backup ring 130 may include a plurality of segments that extend around the base pipe 110 less than 360°. In one embodiment, internal backup ring 130 may have a length 150 that is greater than its height 160. Thus, the internal backup ring 130 may extend through swellable sealing element 120 to stop crack propagation without affecting the ability of the swellable sealing element 120 to swell and thus isolate a portion of the well.

As shown in FIG. 1, a single internal backup ring 130 is disposed extending radially outward from base pipe 110 to the edge of swellable sealing element 120. As illustrated, internal backup ring 130 extends from base pipe 110 to the furthest radial edge of swellable sealing element 120. In certain embodiments, internal backup ring 130 may form a part of the outside diameter 140 of swellable packer 100, e.g., it may be machined in place. Thus, in such an embodiment, internal backup ring 130 may extend completely through swellable sealing element 120. Internal backup ring 130 may be disposed in various other orientations, as are discussed in detail below. In other embodiments, the internal backup ring 130 may be a separate piece affixed to the base pipe 110 by a weld or set screw. However it may be fabricated, there is no leak path under or through the internal backup ring 130.

Figure 2:
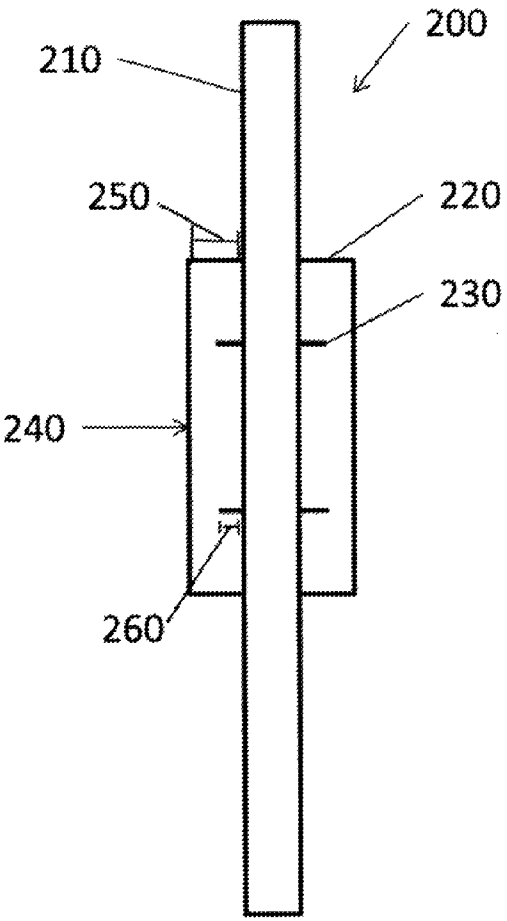
FIG. 2 is a cross-sectional view of a swellable packer according to embodiments of the present disclosure.

Referring now to FIG. 2, a cross-sectional view of a swellable packer according to embodiments of the present disclosure is shown. In this embodiment, swellable packer 200 includes a base pipe 210 and a swellable sealing element 220, as discussed above with respect to FIG. 1. Swellable packer 200 further includes a plurality of internal backup rings 230. While FIG. 1, above, illustrates a swellable packer having a single internal backup ring, in certain embodiments, it may be advantageous to include multiple internal backup rings 230 to further stop cracks from propagating. As illustrated in FIG. 2, swellable packer 200 includes two internal backup rings 230 disposed within swellable sealing element 220. Internal backup rings 230 extend radially outward from base pipe 210 through swellable sealing element 220 and terminate approximately 50% through the thickness 250 of swellable sealing element 220.

Depending on the requirements of swellable packer 200, the length 260 of internal backup rings 230 may vary. For example, in certain embodiments, the length of internal backup rings 230 may extend about 25 percent of the thickness 250 of swellable sealing element 220, about 50 percent of the thickness 250 of swellable sealing element 220, about 75 percent of the thickness 250 of swellable sealing element 220, or greater. In particular embodiments, such as those described with respect to FIG. 1, the length 260 of internal backup rings 230 may extend to the outer diameter 240 of swellable sealing element 220.

Figure 3:
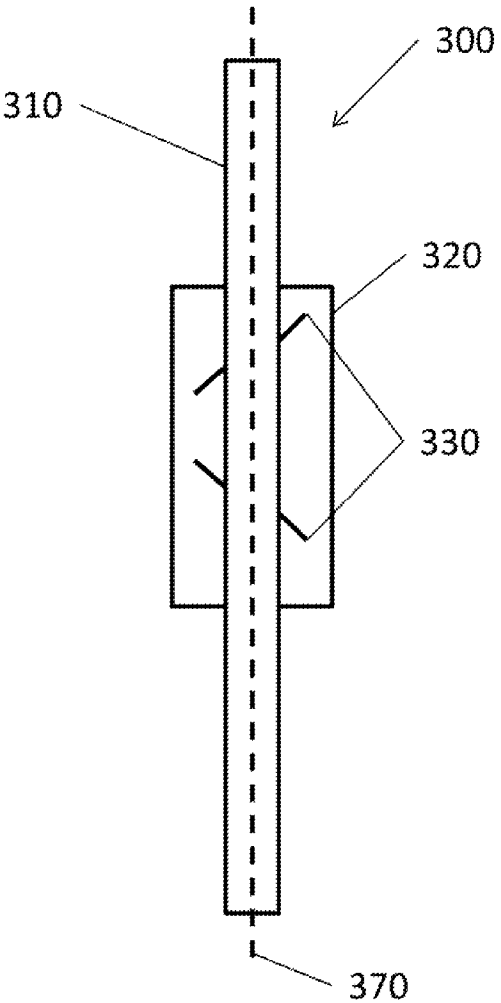
FIG. 3 is a cross-sectional view of a swellable packer according to embodiments of the present disclosure.

Referring to FIG. 3, a cross-sectional view of a swellable packer 300 according to embodiments of the present disclosure is shown. In this embodiment, swellable packer 300 includes a base pipe 310 and a swellable sealing element 320, as discussed above with respect to FIGS. 1 and 2. Swellable packer 300 further includes a plurality of internal backup rings 330. In this embodiment, internal backup rings 330 are angled with respect to an axis 370 of swellable packer 300. Internal backup rings 330 may be disposed to have varying angles with respect to axis 370. For example, as described above with respect to FIGS. 1 and 2, the internal backup rings (130 and 230) may be disposed at approximately 90° with respect to axis 370. In alternative embodiments, such as shown in FIG. 3, internal backup rings 330 may be disposed at about 45° with respect to axis 370. Internal backup rings 330 may also be disposed with respect to axis 370 at various other angles, for example, angles less than or greater than 45°.

Figure 4:
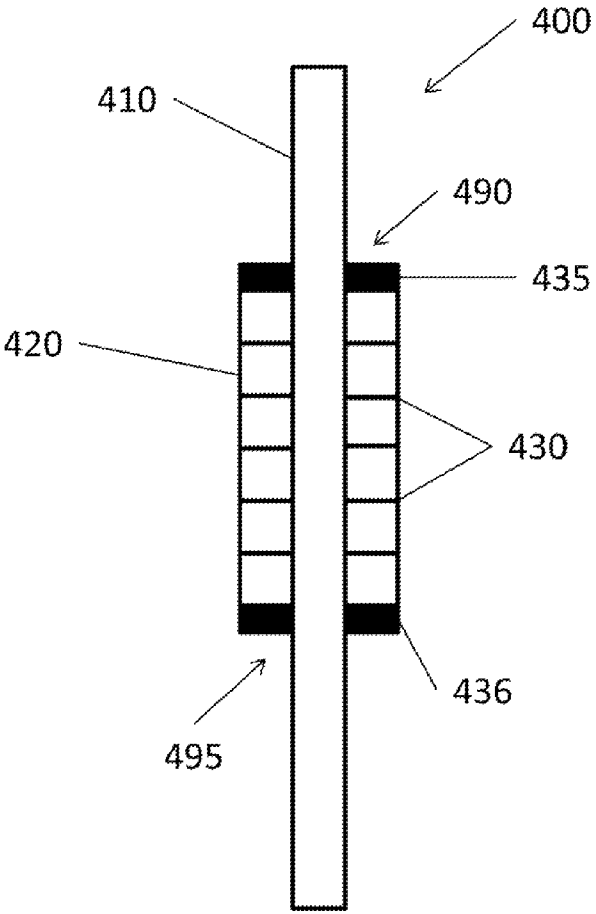
FIG. 4 is a cross-sectional view of a swellable packer according to embodiments of the present disclosure.

Referring to FIG. 4, a cross-sectional view of a swellable packer 400 according to embodiments of the present disclosure is shown. In this embodiment, swellable packer 400 includes a base pipe 410 and a swellable sealing element 420, as discussed above with respect to FIGS. 1, 2, and 3. Swellable packer 400 further includes a plurality of internal backup rings 430. As illustrated, the internal backup rings 430 are disposed with approximately equal spacing along the length of swellable sealing element 420. In alternate embodiments, internal backup rings 430 may be spaced at distances along the length of swellable sealing element 420 that are not equal. For example, a greater number of internal backup rings may be disposed on a first end 490 of swellable sealing element 420 as opposed to a second end 495 of swellable sealing element 420. Those of ordinary skill in the art having benefit of this disclosure will appreciate that groups of internal back up rings 430 may be concentrated in selected portions of swellable sealing element 420.

Swellable packer 400 further includes a first end ring 435 and a second end ring 436. End rings 435 and 436 are disposed at the first end 490 of swellable sealing element 420 and the second end 495 of swellable sealing element 420, respectively. End rings 435 and 436 are configured to hold the swellable sealing element 420 in place, thereby preventing the swellable sealing element 420 from expanding longitudinally along the length of drill pipe 410. By preventing swellable sealing element 420 from expanding longitudinally along the length of drill pipe 410, the sealing integrity of swellable packer 400 may be increased. End rings 435 and 436 may further prevent crack propagation by preventing a crack from extending to the end of the swellable sealing element 430.

Those of ordinary skill in the art having the benefit of the present disclosure will appreciate that in certain embodiments, swellable packer 400 may only have a single end ring (i.e., either 435 or 436). In such an embodiment, the single end ring 435/436 may be applied such that the end ring is on an end of swellable packer 400 that is receiving the pressure. For example, if swellable packer 400 is disposed in a well to seal off an upper portion of a well from a lower portion of a well, the end ring 435/436 may be disposed on a lower or distal portion of the tool to prevent fluid from moving upward. This will be described in greater detail below.

Figure 5:
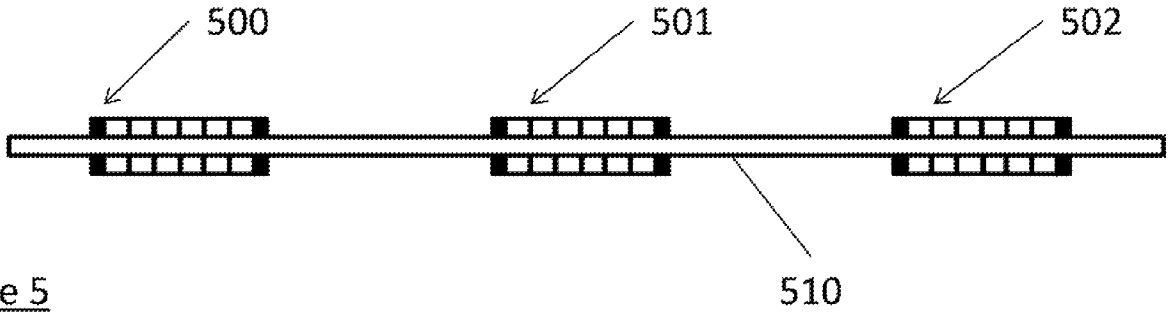
FIG. 5 is a cross-sectional view of a plurality of swellable packers according to embodiments of the present disclosure.

Referring briefly to FIG. 5 a cross-sectional view of a plurality of swellable packers according to embodiments of the present disclosure is shown. In this embodiment, three swellable packers 500, 501, and 502 are coupled together. The swellable packers 500-502 may be implemented, for example, using the embodiment of FIG. 4. Such a tool may be used to provide redundancy in sealing off a portion of a well, or may alternatively be used to section off multiple zones within a well. When used to provide redundancy in sealing off a portion of a well, the swellable packers 500, 501, and 502 may share a common base pipe 510. When multiple swellable packers 500, 501, and 502 are used to isolate sections of the well, the swellable packers 500, 501, and 502 may be placed tens or hundreds of feet apart within the well. In this situation, the swellable packers 500, 501, and 502 may not share a common base pipe 510. The base pipes 510 may be connected, for example through threadable connections (not shown), to each other or to intermediate sections of pipe used to form the string (not shown).

Figure 6:
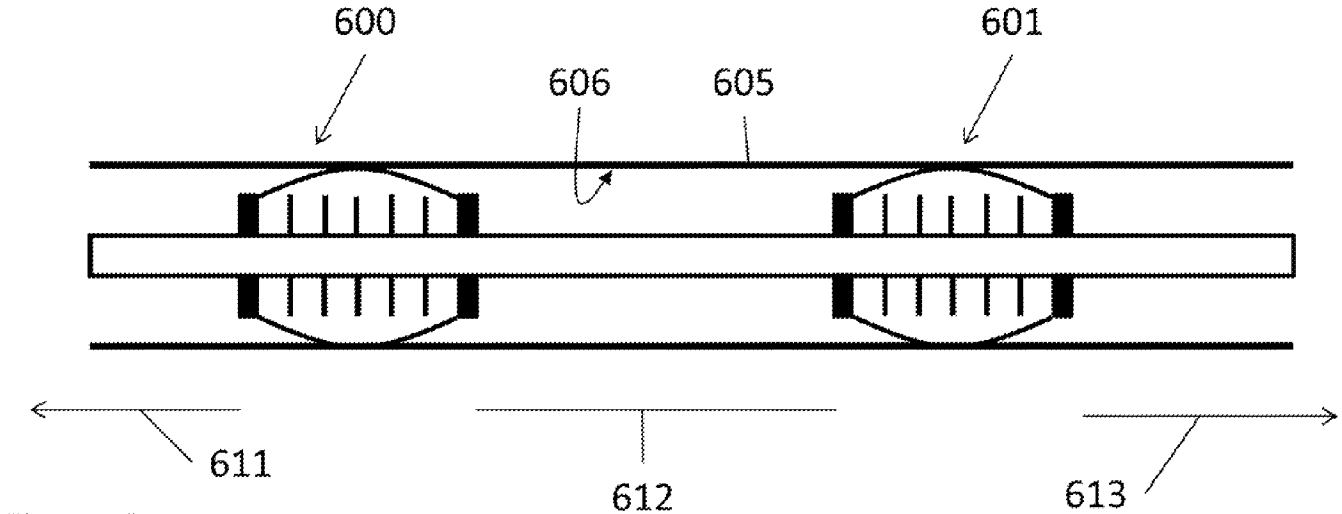
FIG. 6 is a cross-sectional view of two swellable packers disposed in a well according to embodiments of the present disclosure.

Referring to FIG. 6, a cross-sectional view of a plurality of swellable packers disposed within a well according to embodiments of the present disclosure is shown. In this embodiment, two swellable packers 600 and 601 are shown disposed within a well 605. Those of ordinary skill in the art will appreciate that various types of wells may employ swellable packers, such as swellable packers 600 and 601. Wells 605 may be either cased or uncased. The term well wall 606, as used herein, refers to the inside diameter of the well, regardless of whether the well is cased or uncased.

FIG. 6 illustrates swellable packers 600 and 601 after the swellable sealing element 620 has radially expanded into contact with well wall 606. The use of two swellable packers 600 and 601 may thus be used to create three zones 611, 612, 613 within the well. Those of ordinary skill in the art will appreciate that isolating particular sections of a well 605 into zones, such as zones 611, 612, and 613 is used to perform particular operations within a specific section of a well 605. For example, by isolating zones 611, 612, and 613 within the well, fluids may be produced from a particular zone or fluids may be prevented from entering an adjacent zone.

Methods of using swellable packers according to embodiments of the present disclosure are described below.

Figure 7:
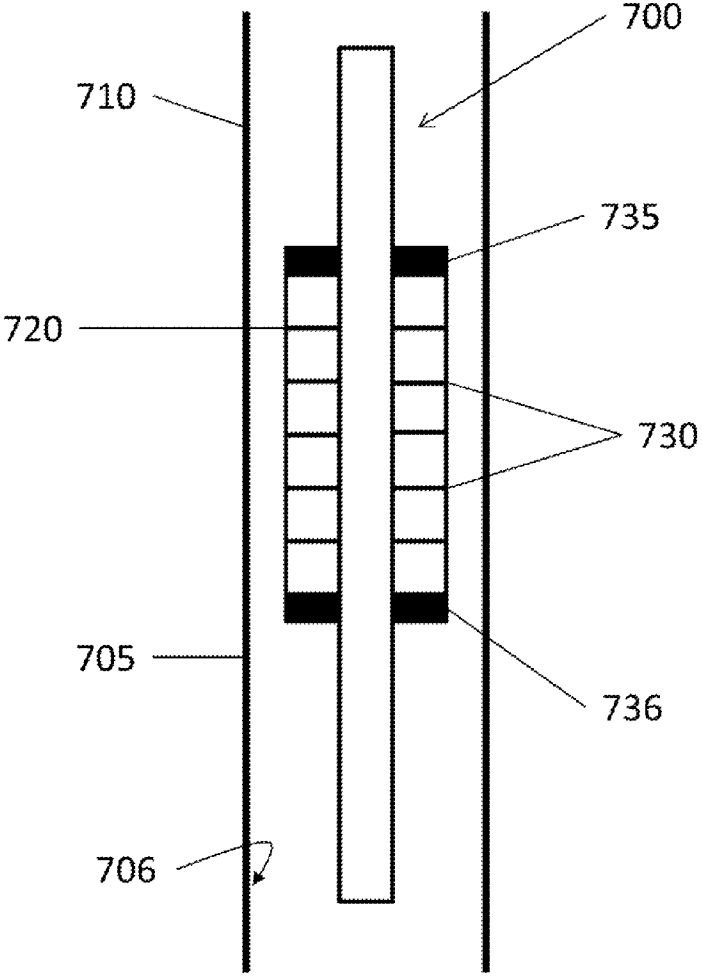
FIG. 7 is a cross-sectional view of a swellable packer disposed in a well in an inactivated condition according to embodiments of the present disclosure.

Referring to FIG. 7, a cross-sectional view of a swellable packer in an unexpanded condition, according to embodiments of the present disclosure is shown. In this embodiment, a swellable packer 700 having a base pipe 710 a swellable sealing element 720, a plurality of internal backup rings 730 (only two indicated), and end rings 735, 736 is disposed in a well 705. The well 705 may be cased or uncased and has a well wall 706. The swellable packer 700 is run into the well 705 on pipe (not shown), wireline (not shown), coiled tubing (not shown), or other methods of deploying downhole tools into a well 705 as is known in the art. Swellable packer 700 is lowered to a section of well 705, so that the well 705 may be divided into multiple zones, as described above with respect to FIGS. 5 and 6.

When the swellable packer 700 is located at the position inside well 705, fluid may be flowed into the well 705 in order to expand swellable sealing element 720. As explained above, the fluid may be water-based or hydrocarbon-based. The fluid may be, for example, a reservoir fluid flowing into the well 705 from the reservoir and/or a manmade fluid flowing into the well 705 from the head of the well 705. The fluid may be implemented and its introduction into the well may be performed in suitable manner known to the art. Upon contact with the fluid, swellable sealing element 702 swells, thus radially expanding into contact with well wall 706.

Figure 8:
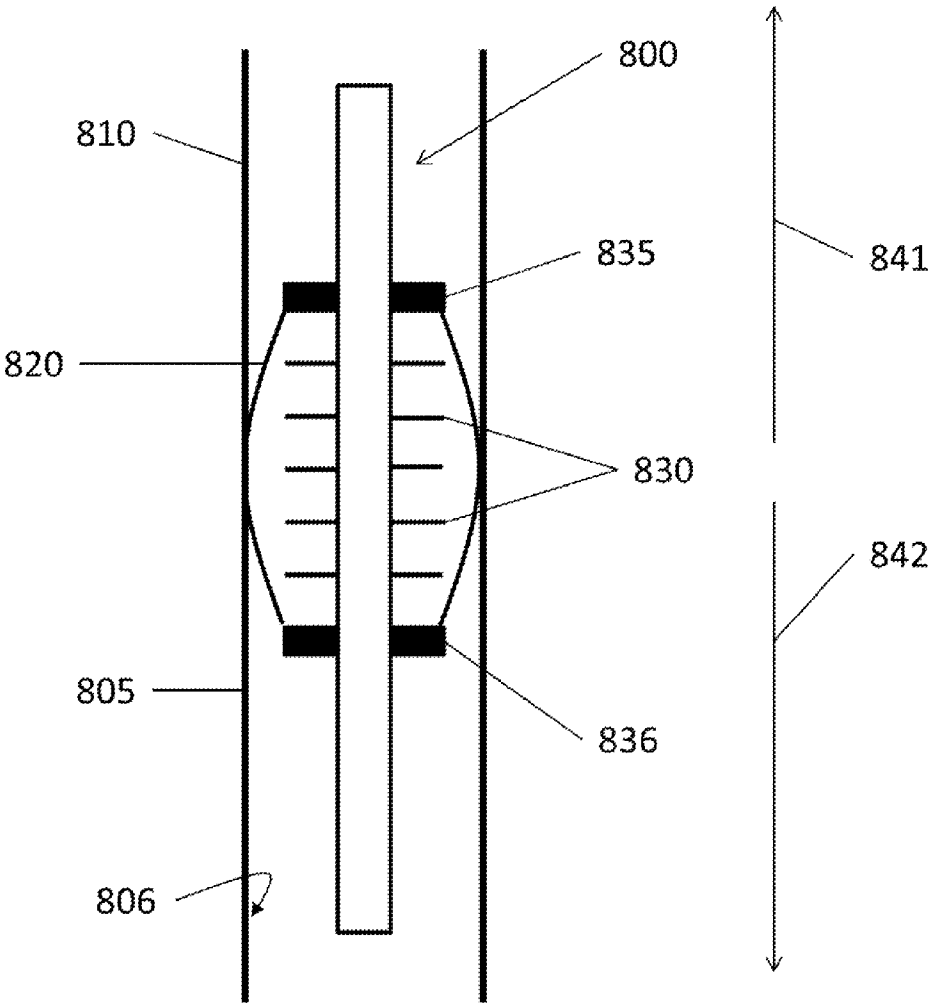
FIG. 8 is a cross-sectional view of a swellable packer disposed in a well in an activated condition according to embodiments of the present disclosure.

Referring to FIG. 8, a cross-sectional view of a swellable packer in an expanded condition, according to embodiments of the present disclosure is shown. Swellable packer 800, as described above, incudes a base pipe 810, a swellable sealing element 820, a plurality of internal backup rings 830, and end rings 835/836. After contact with a fluid, the swellable sealing element 820 has radially expanded into contact with a well wall 806 of the well 805. By contacting the well wall 806 with swellable sealing element 820, a lower zone of a well 841 and an upper zone of a well 842 are created. Thus, fluid from the lower zone 841 cannot flow to upper zone 842 and fluid from upper zone 842 cannot flow to lower zone 841, thereby isolating the two sections of well 805.

As illustrated, internal backup rings 830 may not extend through the entire thickness 840 of swellable sealing element 820 when swellable sealing element 820 is radially expanded. Those of ordinary skill in the art will appreciate that the distance between internal backup rings 830 and well wall 806 is exaggerated in FIG. 8 for purposes of illustration. In practice, the distance between an end of internal backup rings 803 and well wall 806 may be substantially less. For example, in certain embodiments, the distance between the end of internal backup rings 803 and well wall 806 may be a fraction of an inch.

Figure 9:
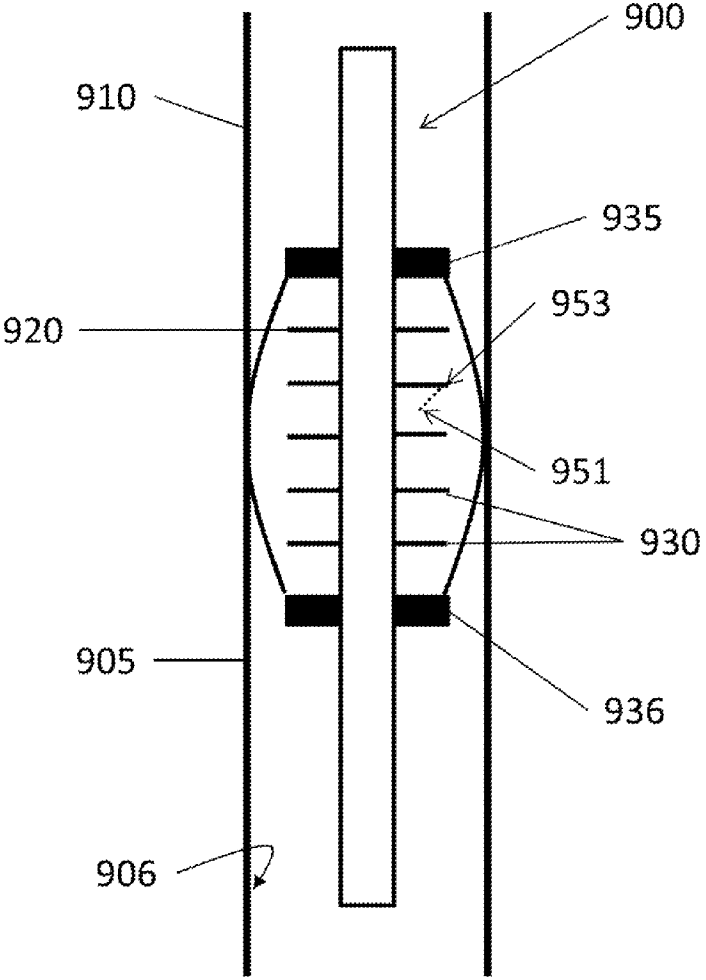
FIG. 9 is a cross-sectional view of a swellable packer having a propagating crack according to embodiments of the present disclosure.

Referring to FIG. 9, a cross-sectional view of a swellable packer in an expanded condition, according to embodiments of the present disclosure is shown. Swellable packer 900, as described above, incudes a base pipe 910, a swellable sealing element 920, a plurality of internal backup rings 930, and end rings 935,936. After contact with a fluid, the swellable sealing element 920 has radially expanded into contact with a well wall 906 of the well 905.

As operations in the well 905 continue, swellable sealing element 920 may be exposed to high temperatures, pressures, and environments that may degrade the elastomeric materials. When the elastomeric materials begin to degrade, cracks, such as crack 951 may form in the swellable sealing element 920. Crack 951 may propagate throughout swellable sealing element 920. As crack 951 propagates, the crack will contact an internal backup ring 930 at location 953 and stop growing. Because the crack cannot propagate past internal backup ring 930, the crack may not result in failure of the swellable sealing element 920.

Methods of manufacturing swellable packers according to embodiments of the present disclosure are described below.

In the manufacture of swellable packers according to embodiments of the present disclosure, at least one internal backup ring is disposed on a base pipe. The internal backup ring may be disposed on the pipe through a variety of methods including, for example, brazing or bonding the internal backup ring to the base pipe. Alternatively, the internal backup ring may be connected to the base pipe through threadable connections or press-fitting. In certain embodiments, the internal backup may not be permanently secured to the base pipe and may instead float within the elastomeric material. As described above, in certain embodiments, a plurality of internal backup rings may be disposed on the base pipe.

After the internal backup ring is disposed on the base pipe, an elastomeric material is applied over a section of the base pipe and the internal backup ring. The elastomeric material may be applied by winding threads of a substrate over the section of base pipe and the internal backup ring. The method may further include applying a bonding agent over the section of base pipe and the internal backup ring. The amount of elastomeric material used may be determined by the diameter of swellable sealing element that is required.

More particularly, the internal backup rings are either affixed to the base pipe, or the base pipe is machined in such a way as to include the internal backup rings. The rubber is then wrapped around the base pipe to a predetermined OD. The rubber may or may not be bonded to the base pipe. The rubber may or may not be bonded to the end ring. The rubber may or may not be bonded to the internal backup ring. The rubber may be wrapped in one section, then the backup ring put in place. Then the rubber is wrapped on the second section, then the next backup ring put in place. Both scenarios work. After the packer is rapped, it is put in an autoclave for curing.

Depending on the requirements of the operation, the internal backup ring(s) may extend radially outward from the base pipe completely through the swellable sealing element, or alternatively, may terminate part way through the swellable sealing element. For example, in certain embodiments, the internal backup ring(s) may extend radially outward from the base pipe through at least 50 percent, at least 75 percent, or greater of the elastomeric material. Additionally, the length of the radial extension may be greater than the height of the internal backup rings. Because the internal backup rings are configured to prevent crack propagation, the height of the internal backup rings is of less significance.

In certain embodiments, one or more end rings may be secured to one or more ends of the elastomeric material in order to hold the elastomeric material in place. Additionally, as described above, by securing one or more ends of the elastomeric material, the elastomeric material is prevented from extruding longitudinally along the length of the base pipe. The end rings also help protect the tool while being deployed in the hole. The use of end rings in this way is known to the art and any known suitable technique may be used.

Advantageously, embodiments of the present disclosure may provide swellable packers that resist crack propagation during use. By truncating crack propagation at one or more internal backup rings, the crack is not allowed to spread and thus the sealing integrity of the packer is maintained. Because the sealing integrity of the packer is maintained, the time consuming and expensive task of retrieving a failed packer and replacing the packer is prevented, thereby decreasing the costs associated with particular well operations.

While the present disclosure has been described with respect to a limited number of embodiments, those skilled in the art, having benefit of this disclosure, will appreciate that other embodiments ma be devised which do not depart from the scope of the disclosure as described herein. Accordingly, the scope of the disclosure should be limited only by the attached claims.

What is claimed:

1. A swellable packer, comprising:

a base pipe;

a swellable sealing element disposed around the outer diameter of the base pipe; and at least one internal backup ring extending radially outward from the base pipe, wherein at least a portion of the at least one internal backup ring is disposed within the swellable sealing element, and wherein the swellable sealing element is bonded to a section of the at least one internal backup ring and a section of the base pipe.

2. The swellable packer of claim 1, further comprising a first end ring disposed proximate a first end of the swellable sealing element.

3. The swellable packer of claim 2, further comprising a second end ring disposed proximate a second end of the swellable sealing element.

4. The swellable packer of claim 1, further comprising a plurality of internal backup rings.

5. The swellable packer of claim 1, wherein the swellable sealing element is configured to increase in volume when contacted by a water-based fluid.

6. The swellable packer of claim 1, wherein the swellable sealing element is configured to increase in volume when contacted by a hydrocarbon-based fluid.

7. The swellable packer of claim 1, wherein the at least one internal backup ring is disposed at an angle with respect to the base pipe.

8. The swellable packer of claim 1, wherein the at least one internal backup ring comprises a composite material.

9. The swellable packer of claim 1, wherein a bonding agent is applied to the section of the at least one internal backup ring and the section of the base pipe.

10. A swellable packer, comprising a base pipe;

a swellable sealing element disposed around the outer diameter of the base pipe; and at least one internal backup ring disposed within the swellable sealing element, wherein the at least one internal backup ring extends radially from the base pipe, and wherein a bonding agent is applied to a section of the at least one internal backup ring and a section of the base pipe.

11. The swellable packer of claim 10, wherein the at least one internal backup ring comprises a circular disk.

12. A method of manufacturing a swellable packer, the method comprising:

disposing at least one internal backup ring on a base pipe, wherein the at least one internal backup ring extends radially outward from the base pipe;

applying an elastomeric material over a section of the base pipe and at least a portion of the at least one internal backup ring; and applying a bonding agent over the section of the base pipe and the at least one internal backup ring.

13. The method of claim 12, further comprising securing a first end of the elastomeric material in place on the base pipe.

14. The method of claim 13, further comprising securing a second end of the elastomeric material in place on the base pipe.

15. The method of claim 12, wherein the at least one internal backup ring extends radially outward from the base pipe through at least 50 percent of the elastomeric material.

16. The method of claim 12, wherein the at least one internal backup ring extends radially outward from the base pipe through at least 75 percent of the elastomeric material.

17. The method of claim 12, comprising disposing a plurality of internal backup rings on the base pipe.

18. A method of isolating a section of a well, the method comprising:

disposing a swellable packer in the well, the swellable packer comprising a base pipe, at least one internal backup ring extending radially outward from the base pipe, and an elastomeric material disposed over at least a section of the base pipe and at least a portion of the at least one internal backup ring, wherein the elastomeric material is bonded to a section of the base pipe and a section of the at least one internal backup ring; and exposing the swellable packer to a fluid, wherein the fluid exposure causes the elastomeric material to radially expand into contact with a well wall.

19. The method of claim 18, wherein the at least one internal backup ring is configured to reduce crack propagation in the elastomeric material.

20. The method of claim 18, wherein exposing the swellable packer to a fluid includes exposing the swellable packer to a reservoir fluid.

* * * * *